US005736692A

United States Patent [19]

Lumme et al.

[11] Patent Number: 5,736,692

[45] Date of Patent: *Apr. 7, 1998

[54] REMOTE CONTROLLER LINKAGE TO AN ELEVATOR SYSTEM

[75] Inventors: Jorma Lumme, Rixenart, Belgium; Asko Juntunen; Matti Kujala, both of Hyvinkää, Finland

[73] Assignee: Kone Oy, Helsinki, Finland

[*] Notice: The term of this patent shall not extend beyond the expiration date of Pat. No. 5,554,832.

[21] Appl. No.: 639,796

[22] Filed: Apr. 29, 1996

Related U.S. Application Data

[62] Division of Ser. No. 412,850, Mar. 29, 1995, Pat. No. 5,554,832, which is a continuation of Ser. No. 171,440, Dec. 22, 1993, abandoned.

[30] Foreign Application Priority Data

Dec. 22, 1992 [FI] Finland ..... 925843

[51] Int. Cl.[6] ..... B66B 1/28

[52] U.S. Cl. ..... 187/247; 187/395; 187/393

[58] Field of Search ..... 187/391, 393, 187/247, 392

[56] References Cited

U.S. PATENT DOCUMENTS

| | | | |
|---|---|---|---|
| 3,973,648 | 8/1976 | Hummert et al. | 187/29 R |
| 4,195,712 | 4/1980 | Kuhl | 187/29 R |
| 4,497,391 | 2/1985 | Meguerdichain et al. | 187/29 R |
| 4,655,324 | 4/1987 | Meguerdichain et al. | 187/121 |
| 4,673,911 | 6/1987 | Yoshida | 187/100 |
| 4,685,538 | 8/1987 | Kamaike | 187/121 |
| 4,742,893 | 5/1988 | Otala et al. | 187/121 |
| 4,979,594 | 12/1990 | Begle et al. | 187/121 |
| 5,007,506 | 4/1991 | Suzuki et al. | 187/101 |
| 5,200,583 | 4/1993 | Kupersmith et al. | 187/126 |
| 5,554,832 | 9/1996 | Lumme et al. | 187/380 |

FOREIGN PATENT DOCUMENTS

| | | | |
|---|---|---|---|
| 541490 | 7/1987 | Canada . | |
| 3330345 | 3/1985 | Germany . | |
| 1-226086 | 9/1989 | Japan . | |
| 1-231793 | 9/1989 | Japan . | |
| 3-152069 | 6/1991 | Japan . | |
| 3-272977 | 12/1991 | Japan . | |
| 2136158 | 9/1984 | United Kingdom | 187/393 |

*Primary Examiner*—Robert Nappi

[57] ABSTRACT

A remote controller linkage is established to an elevator system having one or more elevators and using a data transmission network (21) comprising at least one serial communication bus for the transmission of control signals between the operating and/or other devices belonging to the system, car calls, landing calls and other information obtained from and/or generated by the devices included in the elevator system. At least one of the serial communication buses belonging to the data transmission network (21) of the elevator system is connected to a functional unit (3,7,10,13) fitted to receive messages sent to it by a remote controller (1,22). On the basis of the message received, the functional unit (3,7,10,13) transmits into the serial communication bus a message containing at least one control, call or other datum and the bus address of the transmitting functional unit (3,7,10,13).

22 Claims, 3 Drawing Sheets

REMOTE CONTROLLER LINKAGE TO AN ELEVATOR SYSTEM

This application is a divisional of application Ser. No. 08/412,850 U.S. Pat. No. 5,554,832 filed on Mar. 29, 1995, which was a continuation of Ser. No. 08/171,440 filed Dec. 22, 1993, now abandoned, the entire contents of which are hereby incorporated by reference.

FIELD OF THE INVENTION

The present invention relates to a remote controller linkage elevator system.

BACKGROUND OF THE INVENTION

In some situations in elevator operation, it would be appropriate or at least convenient to be able to control the call functions of the elevator or e.g. the door functions by a method other than by pressing the fixed call or other buttons of the elevator. The use of a remote controller for giving landing calls to an elevator is know e.g., U.S. patent publication Ser. No. 4,673,911 (Yoshida) describes a remote controller for an elevator. By means of this controller, a landing call is transmitted to a receiver located in a landing call button unit, from where the call is passed on to the elevator control system. The elevator control system returns a call acknowledgement signal, which is sent on by a transmitter contained in the landing call button unit to the remote controller, where the acknowledgement of the call is indicated by a signal light. Functionally, this device can be regarded as a remote controller of landing call buttons, or as a duplicate of the landing call buttons in the landing call button unit, implemented as a remote controller.

To meet the needs to achieve a system for remote control which allows an elevator to be provided with several features controllable by a remote controller without having to provide a separate remote controller for each function, or without restricting the control of a given function to a given remote controller, a new type of remote controller linkage to an elevator system is needed. The needs for remote control must be adaptive from elevator to elevator depending on the building, the use for which the elevator is intended, etc. Relating to the installation, operation or maintenance of the elevator, these operational situations could include the following:

- Calling an elevator to the floor without having to walk to the call button and press it, making it possible to significantly reduce the waiting time the passenger has to wait in front of the elevator door, or to eliminate the waiting time altogether.
- When it is necessary, e.g. when loading goods into or from the elevator car, to keep the doors open for a longer time than the door contol system would otherwise keep them.
- Sending the elevator to seperate floor without having to enter the car and give a car call.
- Various special situations in elevator operation, requires permission for special operation generally requires the use of a key. Remembering, carrying and using several keys to perform special operations is troublesome. The inventive remote controlled system can replace the need for such keys.
- Certain stages of operation during installation and maintenance where it is necessary to work at a location distant from the call buttons but which require frequent pressing of the buttons. (In some cases, the prior art requires a helper necessary in installation and maintenance work only for the purpose of pressing the call buttons.)

SUMMARY OF THE INVENTION

The remote controller linkage to an elevator system of the present invention is intended for use in an elevator environment where the control commands and other information between different units of the system are transmitted in the form of serial communication messages. The remote controller linkage of the invention is defined by the claims characterization part of claim 1.

The advantages achieved by the remote controller linkage of the invention include the following:

- Remote operation can be realized in a relatively simple manner in the operational situations listed above, relating to installation, operation and maintenance.
- The remote controller linkage practically means linking to the data transmission network of the elevator system, not just to an individual functional unit, so that, in principle, a remote controller can be used for the control of almost any functional unit in the elevator system.
- The remote controller linkage can be used, e.g., to connect a serviceman's terminal device to the elevator system. This allows the serviceman to obtain information about the condition of the elevator system and the required service operations immediately upon entering the building.
- During installation, the elevator can be operated even if the call buttons have not yet been installed because of the risk of their getting damaged or dirty.
- It is possible to establish a remote controller linkage to an individual elevator just as well as to an elevator group consisting of several elevators.

The remote controller linkage of the invention is applicable, e.g., in the following cases:

- Giving a landing call via a remote controller. The remote controller could be simply a call transmitter or it could also receive an acknowledgement and indicate it by a light and/or sound signal.
- Implementing a linkage for special users. Such a user could also give car calls and priortizes calls/locking commands to move the elevator to a desired floor or to reserve it for a given use. Moreover, the elevator doors can be held open for as long a time as necessary. Such a linkage for special users is applicable for VIP operation, transport of patients in a hospital, transport of goods, special functions necessary for slow-moving handicapped persons etc.
- Upon entering a building, a serviceman could immediately obtain information via a special remote controller unit about the condition of the elevators, the position of each elevator and possibly a fault diagnosis: which elevator has failed, which part or unit of it has a fault or malfunction, etc. The information could be presented via a display incorporated in the remote control device of the serviceman/installer or possibly via a display unit belonging to the elevator system.
- An installer could control the elevator by means of his remote controller in a desired manner. The elevator could be used for goods transport even if all landing and car call buttons have not yet been installed.
- In connection with certain adjustments and other measures relating to elevator maintenance and installation which normally involve work at several functional units. An example of such measures is aligning the load-weighing device of the elevator with the aid of a remote controller.

In access control, user identification can be implemented using a remote controller instead of e.g. a magnetic card and card reader. This is applicable especially when the elevator system is linked to a general access control system in the building, and also when identification is required before access into the elevator is permitted. This allows identification without queueing up in front of a card reader during peak traffic. In fact, the need for a card reader or other specific access control device in the elevator lobby is diminished or eliminated altogether.

BRIEF DESCRIPTION OF THE DRAWINGS

The embodiments of the invention are described in detail by the following and by the aid of referring to the attached drawings, in which.

DETAILED DESCRIPTION

The functions in a remote controller linkage and the interactions between the user of a remote controller and the elevator system can be illustrated by describing what happens when the elevator is operated by means of a remote controller. In our example, the remote controller linkage concerns the landing and car call functions and the opening and closing of the door.

Figure 1:
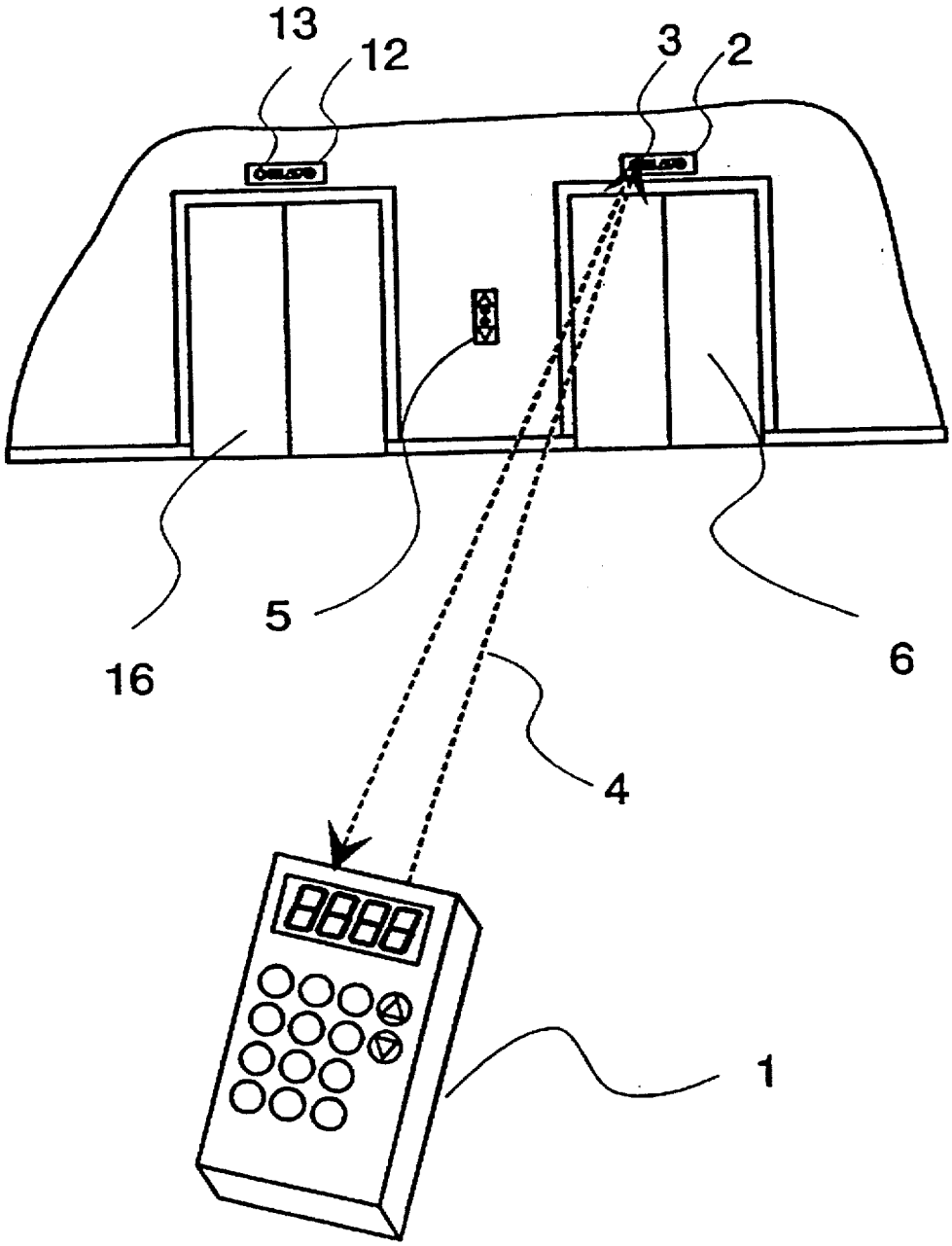
FIG. 1 presents a situation on a landing where remote controller linkage applies to a functional unit comprised in an elevator-specific floor display unit.

FIG. 1 presents a situation where, on a floor served by an elevator group, the elevator system is given a landing call in the form of a remote control message. The figure shows the landing doors 6,16 of two elevators placed side by side and the functional units 2,3,5,12,13 needed for each floor in the elevator system. The message sent by the remote controller 1 contains information as to whether the call is an up or down call, identity data for the remote controller 1 in question, and possibly some additional information. The remote controller identity data may consist of data indicating that the remote controller is part of this particular elevator system, or it may be more specific, e.g. the individual code of a remote controller belonging to a privileged or special user of the elevator system. From the individual code, the elevator system could recognize, e.g., a handicapped user. The signal going from the remote controller I to a transmitter-receiver unit 3 in the elevator-specific floor display unit 2 is shown as a ray 4, although in reality the optic or infrared signal used will spread as it advances, forming a rather broad beam. Placing the transmitter-receiver unit 3 in conjunction with the floor display unit 2 is advantageous in the first place because it ensures that the optical connection between the remote controller 1 and the transmitter-receiver unit 3 will not be blocked by people standing in front of the elevators, and secondly, because integrating the transmitter-receiver unit 3 as one of the functions of the floor display unit 2 provides the advantage that no separate installation is needed and additionally some bus addresses are spared. In the transmitter-receiver unit 3, a serial communication message is generated and transmitted to the data transmission network of the elevator system. The message could have, e.g., the following content: Up-call in transmitter-receiver unit NN with remote controller identification MM, where NN is the bus address of the transmitter-receiver unit 3 and MM is the identifying code of the remote controller 1. The devices connected to the data transmission network of the elevator system listen to the traffic in the bus and respond to messages relevant to their function. When the above message containing a call is sent, at least the controller whose function is to assign an elevator to serve the call, in this case the group controller, will react to it. For the situation where an elevator is already at the landing but with the doors closed, the elevator controller or door controller of this elevator could be so preprogrammed or preset that it will respond to the landing call directly, i.e., to a landing call containing the bus address of any landing call device 5 or transmitter-receiver unit 3 on the floor in question, by causing the doors to open. In any case, the call is registered by the group control system and an acknowledgement confirming the registration of the call is sent.

Figure 2:
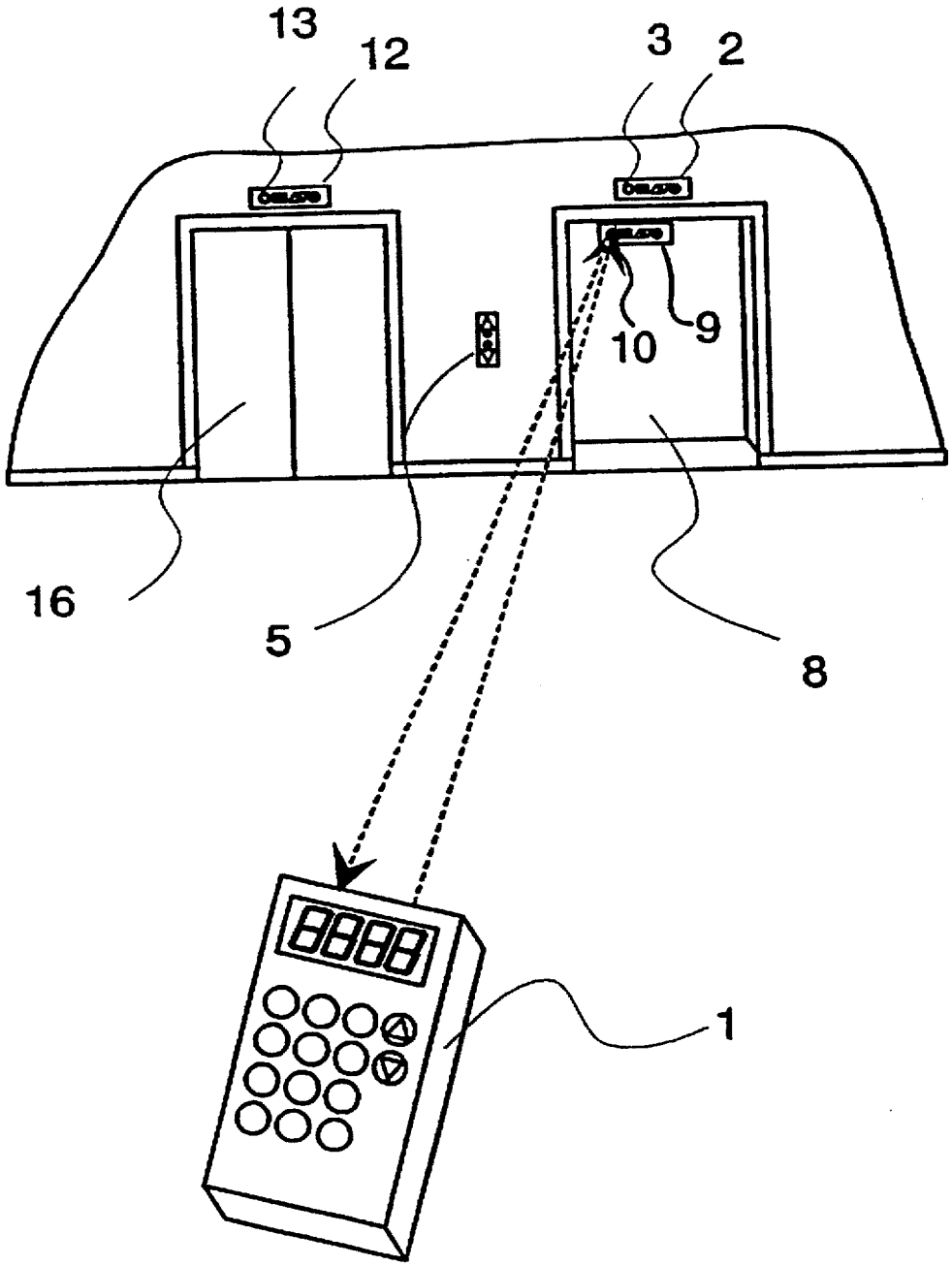
FIG. 2 presents a situation on a landing where remote controller linkage applies to a functional unit comprised in the car display unit of an elevator with its doors open.

In the situation shown in FIG. 2, where an elevator 8 has arrived at a landing and opened its doors, a remote controller 1 is used to establish a link to a functional unit 10 comprised in the car display unit 9. With the same remote controller which was used to send a landing call, instructions can now be given to the elevator just as they would be given through its car call panel, e.g. car calls and commands to close the doors or to keep them open. When control commands are given with a remote controller 1 from the landing to the functional unit 10 inside the car, the beam of visible or infrared light sent by the remote controller 1 may also fall upon the functional unit 3 in the floor display unit 2. In this situation, both the functional unit 3 in the car and that 10 of the floor try to send a message to the control system. A corresponding situation naturally also arises when the beam reaches the functional units 3,13 in the floor display units of two elevators placed side by side. To avoid superfluous messages in the data transmission network and/or in the decision-making process of the control system, each functional unit has a different priority status, which is preferably set in advance or assigned by the control system, and when simultaneous messages originated by the same remote controller appear, only the one generated by the functional unit having the highest priority is sent into the data transmission network and/or taken into account in the decision-making process in the control system.

Figure 3:
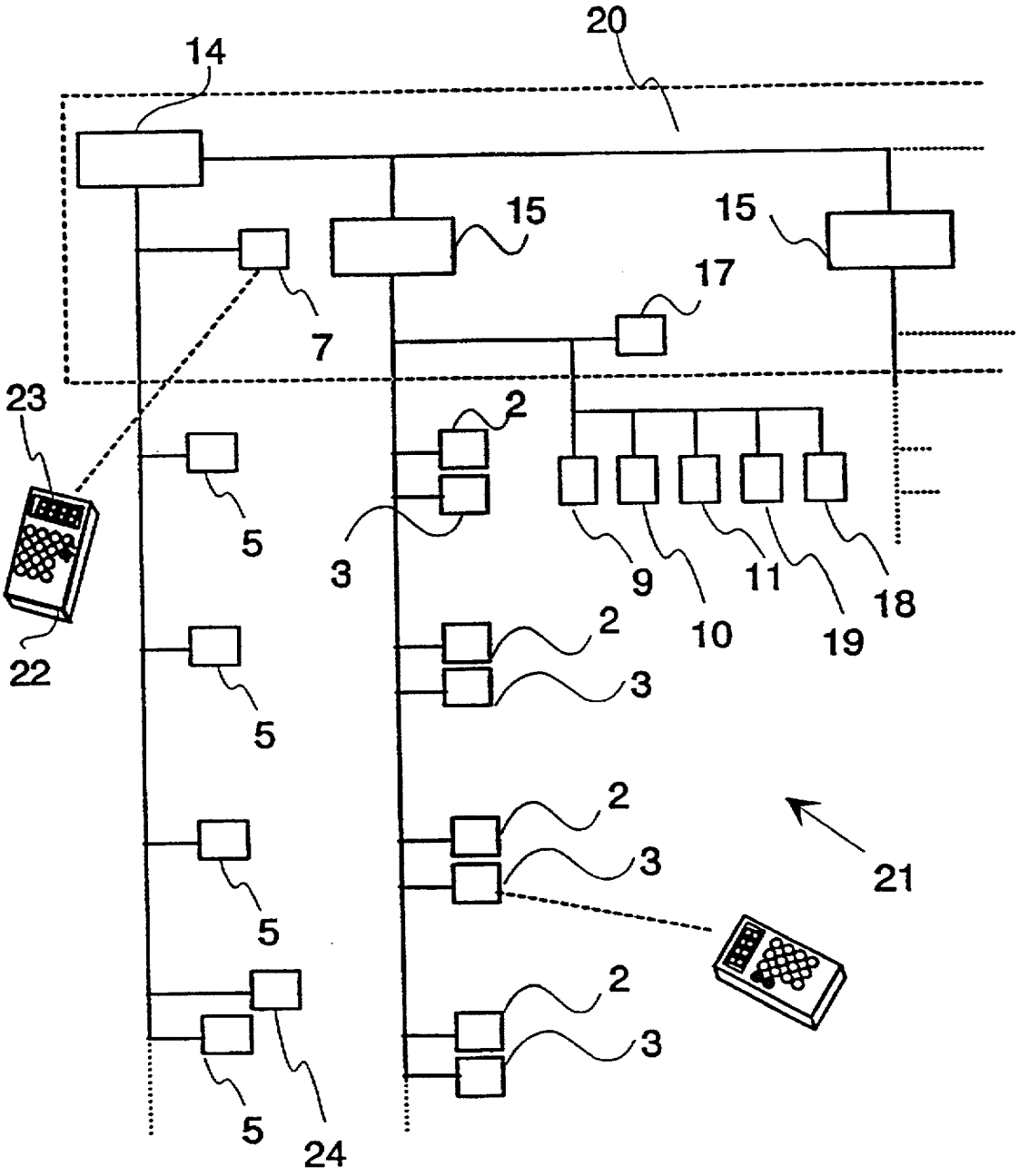
FIG. 3 presents a diagram representing the data transmission network of an elevator system using the remote controller linkage of the invention.

FIG. 3 shows a diagram of the data transmission network 21 of an elevator system, comprising several transmitter-receiver units 3,7 for the remote controller linkage of the invention as well as the elevator and group control devices 14,15, door controllers 19, car and landing call devices 5,11, car display units 9 and elevator-specific floor display units 2, hoisting motor controllers 17 and the load-weighing devices 18 in the cars. Transmitter-receiver units 3,7,10 are provided in the floor display unit 3 on each floor, in the car display unit 9 in each car and in the elevator machine room 20. The data transmission network 21 consists of serial communication buses linked together. Remote controller linkage to the data transmission network 21 can be effected using various types of remote controller. In addition to the remote controllers 1 used to send calls, the system may contain e.g. remote controllers by means of which an elevator can be temporarily detached from the group control system to allow it to be used e.g. for goods transport. A serviceman/installer could have a special remote controller 22 designed for maintenance/installation purposes, through which it is possible to give instructions to the elevator system and obtain diverse information about it. Working via the data transmission network 3, a remote controller 22 like this functions as a temporary control console for the control of a particular functional unit in the elevator system, connected to the data transmission network, e.g. a door controller 19 or the hoisting motor drive 17. In addition to sending control commands, such a console can also be used to monitor and test the operation of the functional unit concerned and, if necessary, to change its operating parameters. A remote controller 22 intended for maintenance/installation purposes generally has a display 23 of its own, but it also has a control function allowing a display unit comprised in the elevator system, e.g., an information display 24 placed in the elevator lobby, to be utilized as an auxiliary display. Especially in the case of a remote controller used for installation or maintenance, but also in connection with other functions effected by means of a remote controller, it is necessary to verify that no inappropriate operations are performed in the system. The verification can be implemented, e.g., by having the group control system or one of the elevator control systems 14,15 check the message transmitted in the bus to see if the action implied by the message is allowed or forbidden in conjunction with the remote controller 1,22 identity included in the message. Based on the verification, the execution of the action implied by the message is either enabled or disabled. A similar verification can be performed regarding the bus address data of the transmitting device comprised in the message.

The combination of a transmitter-receiver unit and a remote controller can even be regarded as a momentary or temporary hardware assembly whose technical characteristics are formed from the characteristics determined by the transmitter-receiver unit and remote controller in each case and possibly also from the functions and functional possibilities assigned to this combination by the elevator system, and whose bus address in the data transmission network is that of the transmitter-receiver unit, and in which the remote controller signal acts as a carrier of the internal data communication within the assembly.

It is obvious to a person skilled in the art that different embodiments of the invention are not restricted to the examples described above, but that they may instead be varied within the scope of the claims presented below. For example, instead of using visible or infrared light as a carrier of the messages between the remote controller and the elevator system, it would be possible to use e.g. radio waves or ultrasound.

We claim:

1. An elevator system responsive to remote control operations comprising:

a data transmission network including at least one serial communication bus;

a plurality of function control units, connected to said serial communication bus, for locally performing distinct elevator functions; and at least one receiver means for receiving remote messages originating from a remote controller and transmitting through said at least one serial communication bus a control message including at least one first control command and the bus address of the receiver means which transmitted the control message;

a controller connected to said at least one communication bus for receiving control messages from said receiver means and determining whether action requested by a received control message must be performed by said controller, and if so, then issuing a second control command;

at least one of said function control units receiving the control messages and, if the action requested by the control message is relevant to the function of a particular function control unit, then the particular function control unit directly performs the requested action.

2. The elevator system according to claim 1, wherein remote controller identity data, identifying the source of the remote message, is included as part of the control message.

3. The elevator system according to claim 2, wherein said controller further determines whether the action requested by the control message is allowed or forbidden based upon the remote controller identity data included in the control message and, based on this determination, either enables or disables the action commanded by the control message.

4. The elevator system according to claim 1, wherein remote controller identity data is included in the remote message, and further wherein the receiver means receiving the remote message determines whether the remote controller is entitled to link to the elevator system in general and only transmits the control message into said at least one serial communication bus if the remote controller is entitled.

5. The elevator system according to claim 1, wherein said controller communicates to the remote controller by transmitting messages through said at least one serial communication bus.

6. The elevator system according to claim 1, wherein the distinct functions performed by said function control units include calling an elevator, opening elevator doors, and sending an elevator car to a specific floor without a user entering the elevator car.

7. The elevator system according to claim 1, further comprising at least one elevator, said at least one elevator being free of elevator buttons.

8. The elevator system according to claim 1, further comprising a remote controller wherein said remote controller has means for connecting to a terminal of a service person, so that the condition of the elevator system and the required service to the elevator system is immediately available to the service person upon entry into a building where the elevator is located.

9. The elevator system according to claim 1, wherein said receiver means are located in a display unit on each floor which is serviced by an elevator, in an elevator car and in an elevator machine room.

10. A method of servicing an elevator system comprising the steps of:

(a) sending a message, including a request-for-information part and an authorization part, to a transceiver by remote control from a service computer, the message being sent immediately upon entering a building where the elevator system is located;

(b) retransmitting the message from the transceiver through a communications bus to a controller;

(c) determining if the request reflected by the request-for-information part of said message is permitted on the basis of said authorization part of said message;

(d) gathering appropriate information responsive to the request if it is determined in step (c) that the request is permitted; and (e) sending a second message, including the gathered information, to the service computer through the communications bus and the transceiver as a function of the determination of step (c) and the action of step (d).

11. The method of claim 10, wherein the request-for-information requests information regarding faults in the elevator system, the second message identifying which elevator has failed and/or which part of the elevator system has malfunctioned.

12. The method of claim 10, wherein the request-for-information requests information regarding the position of elevators, the second message identifying the position of the elevators.

13. The elevator system according to claim 1, wherein remote controller identity data is included in the remote message, and further wherein the receiver means receiving the remote message determines whether the remote controller is entitled to link to the elevator system through that particular receiver means and only transmits the control message if the remote controller is entitled.

14. The elevator system according to claim 1, wherein one of said commanding means is a door controller for an elevator.

15. The elevator system of claim 1, wherein said controller is operative for controlling functions of the elevator system other than the distinct elevator functions performed by said function control units.

16. The elevator system according to claim 6, wherein the control command requests the elevator doors to be kept open for an extended period of time.

17. An elevator system responsive to remote control operations comprising:

a data transmission network including at least one serial communication bus;

at least one receiver means for receiving remote messages originating from a remote controller and for transmitting through said at least one serial communication bus a control message including at least one control command and at least one identifier, the identifier identifying the remote controller or the receiver means which transmitted the control message;

at least one function control unit, connected to said serial communication bus, for performing distinct elevator functions, said at least one function control unit responding differently to received control messages based upon the control command and the at least one identifier and a current status of the elevator system; and a controller, connected to said at least one communication bus, for receiving control messages from said receiver means and determining whether action requested by a received control message requires action by said controller, and if so, then acting on the requested action.

18. The elevator system according to claim 11, wherein the identifier in the control message includes a first identifier identifying the remote controller, and a second identifier identifying the receiver means which transmitted the control message.

19. The elevator system according to claim 18, wherein said at least one function control unit includes an elevator door controller which opens/closes doors of an elevator car, said elevator door controller opening the doors when the first identifier identifies a remote controller which is allowed to communicate with the elevator system and when the current status of the elevator system is such that an elevator car is stopped at a floor.

20. The elevator system according to claim 19, wherein said elevator door controller opens the doors when the first identifier identifies a receiver means through which the identified remote controller is allowed to communicate.

21. The elevator system according to claim 18, wherein said at least one function control unit responds differently based upon a consideration of both the first and second identifiers.

22. The elevator system according to claim 17, wherein said at least one function control unit includes an elevator door controller which opens/closes doors of an elevator car, said elevator door controller opening the doors when the identifier identifies a floor where the receiver means which transmitted the control message is located, and when the current status of the elevator system indicates that the elevator car is at the same floor.

* * * * *